US011885511B2

(12) United States Patent
Kent et al.

(10) Patent No.: US 11,885,511 B2
(45) Date of Patent: Jan. 30, 2024

(54) MODULAR BULKHEAD SYSTEM

(71) Applicants: Matthew Wayne Kent, Saint Augustine, FL (US); Luis Burgos, Jacksonville, FL (US)

(72) Inventors: Matthew Wayne Kent, Saint Augustine, FL (US); Luis Burgos, Jacksonville, FL (US)

(73) Assignee: Q-PAC SYSTEMS, INC., Elkton, FL (US)

( * ) Notice: Subject to any disclaimer, the term of this patent is extended or adjusted under 35 U.S.C. 154(b) by 615 days.

(21) Appl. No.: 16/908,127

(22) Filed: Jun. 22, 2020

(65) Prior Publication Data

US 2021/0372634 A1 Dec. 2, 2021

Related U.S. Application Data

(60) Provisional application No. 62/837,018, filed on Apr. 22, 2019.

(51) Int. Cl.
*F24F 1/0007* (2019.01)
*F04D 29/40* (2006.01)
*F24F 13/20* (2006.01)

(52) U.S. Cl.
CPC ..... *F24F 1/0007* (2013.01); *F04D 29/403* (2013.01); *F24F 2013/205* (2013.01); *F24F 2221/36* (2013.01)

(58) Field of Classification Search
CPC ..... F24F 1/0007; F24F 2013/205; F24F 2221/36; F24F 13/32; F04D 29/403; F04D 29/601; F04D 29/626; F04D 25/166; E04B 2001/2409; E04B 2001/21454; E04B 2001/246; E04B 2001/1936; E04B 2/828; E04B 2/7404
USPC ..... 454/63
See application file for complete search history.

(56) References Cited

U.S. PATENT DOCUMENTS 3,357,763 A * 12/1967 Toper ..... F24F 1/0038 D23/385
3,898,019 A * 8/1975 Reznick ..... F04D 29/626 417/362
4,747,505 A * 5/1988 Hansen ..... F24F 3/0442 220/4.28
4,782,637 A * 11/1988 Eriksson ..... E04B 1/3483 312/263
4,974,386 A * 12/1990 Eriksson ..... E04H 1/1238 312/111
5,284,027 A * 2/1994 Martin, Sr. ..... F24F 3/044 62/298

(Continued)

FOREIGN PATENT DOCUMENTS

CN 208431865 U * 1/2019 ..... F24F 1/0007
KR 101064556 B1 * 9/2011
WO WO-2011004025 A1 * 1/2011 ..... F24F 11/0079

*Primary Examiner* — Edelmira Bosques
*Assistant Examiner* — Frances F. Hamilton
(74) *Attorney, Agent, or Firm* — Lippes Mathias LLP; Mitchell Ghaneie; Claire Patton

(57) ABSTRACT

A structural support system for a fan array system. The system allows for a modular bulkhead wall to be customized and installed within a cabinet of an air handling unit. The modular bulkhead wall comprises one or more intermediate bulkhead stiffening elements that enable the modular bulkhead wall to support the fan array system.

18 Claims, 22 Drawing Sheets

(56) References Cited

U.S. PATENT DOCUMENTS 5,622,058 A * 4/1997 Ramakrishnan ..... F24F 13/20 62/298
6,350,000 B1 * 2/2002 Van Benthem ..... E04H 1/1238 312/236
6,626,017 B2 * 9/2003 Herbeck ..... F16B 2/18 312/265.5
6,662,588 B2 * 12/2003 Houk ..... H05K 7/2059 62/502
6,820,952 B2 * 11/2004 Austin ..... F24F 3/0442 312/326
8,388,715 B2 * 3/2013 Franck ..... F24F 3/044 55/482
8,398,365 B2 * 3/2013 Hopkins ..... F04D 25/166 415/61
8,582,292 B1 * 11/2013 Eichelberg ..... H05K 7/20718 361/695
8,814,639 B1 * 8/2014 Mecozzi ..... F04D 17/16 454/238
8,985,716 B2 * 3/2015 Lundrigan ..... A47B 47/021 312/265.3
9,155,383 B2 * 10/2015 Schluter ..... H05K 7/183
9,857,094 B2 * 1/2018 Son ..... F24F 13/20
9,964,330 B2 * 5/2018 Son ..... F24F 13/20
11,047,593 B2 * 6/2021 Latham ..... F24F 13/20
11,351,493 B2 * 6/2022 Singh ..... B01D 46/12
2003/0011289 A1 * 1/2003 Adams ..... F24F 13/20 312/265.1
2004/0164652 A1 * 8/2004 Chen ..... H05K 7/20172 312/1
2007/0052333 A1 * 3/2007 Freire ..... F24F 13/20 312/265.4
2007/0220851 A1 * 9/2007 Parker ..... B01D 46/0013 55/484
2007/0290586 A1 * 12/2007 Rosete ..... F24F 13/20 29/890.035
2008/0035635 A1 * 2/2008 Moffett ..... F24F 8/10 220/4.28
2010/0307733 A1 * 12/2010 Karamanos ..... F24F 12/00 165/254
2011/0138844 A1 * 6/2011 Yamada ..... F24F 13/20 62/419
2011/0291533 A1 * 12/2011 McFarland ..... F24F 13/20 312/236
2013/0118830 A1 * 5/2013 Cursetjee ..... F24F 13/24 29/527.1
2014/0170958 A1 * 6/2014 Cursetjee ..... F24F 13/28 55/385.2
2014/0213169 A1 * 7/2014 Rasmussen ..... H05K 7/1497 220/23.83
2015/0111485 A1 * 4/2015 Son ..... F24F 3/044 454/284
2017/0127568 A1 * 5/2017 Rimler ..... H05K 7/20709
2018/0003398 A1 * 1/2018 Sabbaghian ..... F24F 11/83
2018/0355874 A1 12/2018 Story
2019/0049125 A1 * 2/2019 Carton ..... F16B 19/02
2020/0191432 A1 * 6/2020 Bauch ..... F24F 13/24
2020/0269171 A1 * 8/2020 Vaidya ..... F24F 8/108
2020/0269173 A1 * 8/2020 Salunkhe ..... F24F 13/20
2020/0271332 A1 * 8/2020 Salunkhe ..... F24F 1/38
2022/0064527 A1 * 3/2022 Kwon ..... C09K 11/70
2022/0099333 A1 * 3/2022 Khedekar ..... F24F 13/20

* cited by examiner

MODULAR BULKHEAD SYSTEM

CROSS-REFERENCE TO RELATED APPLICATIONS

This application claims priority of U.S. patent application Ser. No. 62/837,018, filed on Apr. 22, 2019, the contents of which are incorporated by reference herein.

BACKGROUND OF THE INVENTION

A. Field of Invention

The present invention relates to a modular bulkhead system that can be utilized in the HVAC industry. The modular bulkhead system may be installed in new air handling units as well as within existing air handling units.

B. Prior Art

Traditionally, replacing a malfunctioning fan system within an air handling unit often requires removal and replacement of the entire air handling unit. Air handling units are housed in cabinets that often weigh significantly more than the typical person can lift. Furthermore, deconstructing an already existing air handler unit to facilitate removal without a crane does not overcome the challenge of lifting and positioning its replacement. As such, removal and replacement of an already existing air handling unit often requires use of a crane, which can increase costs substantially. Additionally, retrofitting new equipment, such as a new fan system, within the cabinet of an already existing air handling unit is often limited by size of the cabinet doors as well as confined space within the cabinet. A more economical and effective solution for replacing a malfunctioning fan system within an already existing air handing unit is needed.

BRIEF SUMMARY OF THE INVENTION

The present invention provides a unique and novel modular bulkhead system for retrofitting an already existing air handling unit with a new fan array as well as for installing new fan arrays within original equipment manufacturing of new air handling units. Typically, the process of replacing a commercial fan system within an air handling unit is extremely expensive because the entire air handling unit must be removed, and a new air handling unit must be installed in its place. It is not uncommon for this process to require a crane to lift the entire air handler from its location and then placing the new air handler in its place. With the presently described invention, a crane would not be needed to replace a commercial fan system.

This invention allows removal of the old fan system and retrofitting the new fan system in a modular fashion such that each piece to the new fan system can be installed within an already existing air handler. This is accomplished with the unique and novel modular bulkhead system, which provides a bulkhead wall comprised of a plurality of panels that each may be hand carried and installed by one individual within a cabinet housing an air handling unit. The modular bulkhead system further provides a structural frame that is directly attached to the interior of the cabinet. Each panel of the plurality of panels is supported by the structural frame. Once the plurality of panels is installed, a plurality of fans may then be attached to the bulkhead wall at predetermined locations and subsequently connected to the power and control system. Retrofitting an already existing air handling unit with the modular bulkhead system can provide substantial cost savings relative to replacing the already existing air handling unit with an entirely new air handling unit.

NUMBERING REFERENCE

5—Modular bulkhead system
6—Fan
7—Fan plate
8—Panel opening
9—Bulkhead door
10—First side panel
15—Fan panel
20—Second side panel
25—Filler panel
30—Structural frame
31—Transition frame
35—Fastener
40—Pre-punched hole
45—C-channel
46—C-channel lip
47—Stiffening flange
50—Flange
55—Nut-insert
60—Ledge
65—Quick-connect box
80—Cabinet
81—Cabinet door
110—Alternative first side panel
120—Alternative second side panel

DETAILED DESCRIPTION OF THE EMBODIMENTS

A non-limiting exemplary embodiment of the present invention provides a modular bulkhead system 5 that is installed within the airstream of an air handling unit and is capable of supporting an array of one or more fans 6. The modular bulkhead system 5 provides a modular bulkhead wall that supports the array of fans such that they can be easily and cost effectively retrofitted within a cabinet 80. The modular bulkhead wall provides a front surface and a back surface. It is anticipated that the cabinet 80 is provided for an already existing air handling unit or a new air handling unit during its original equipment manufacture. This modular bulkhead system 5 is useful when retrofitting the already existing air handling unit because the cabinet 80, which encloses the air handling unit, restricts access to its interior such that retrofitting a new fan system is not typically possible without also retrofitting the cabinet 80. Accordingly, once a malfunctioning fan system is removed from the already existing air handling unit, each component of the modular bulkhead system 5 can be hand carried by one person into the cabinet 80 to then be installed. As such, the already existing air handling unit may be salvaged, resulting in a plurality of benefits that include a significant cost savings for installation and repair. A non-limiting example of such cost savings is, this modular bulkhead system 5 allows for an individual to install the modular bulkhead system 5 from the front side of the modular bulkhead wall, thereby further reducing time of installation. Consequently, the modular bulkhead system 5 can be customized for virtually any air handling unit within the HVAC industry while maintaining the same or similar method of installation.

Figure 9:
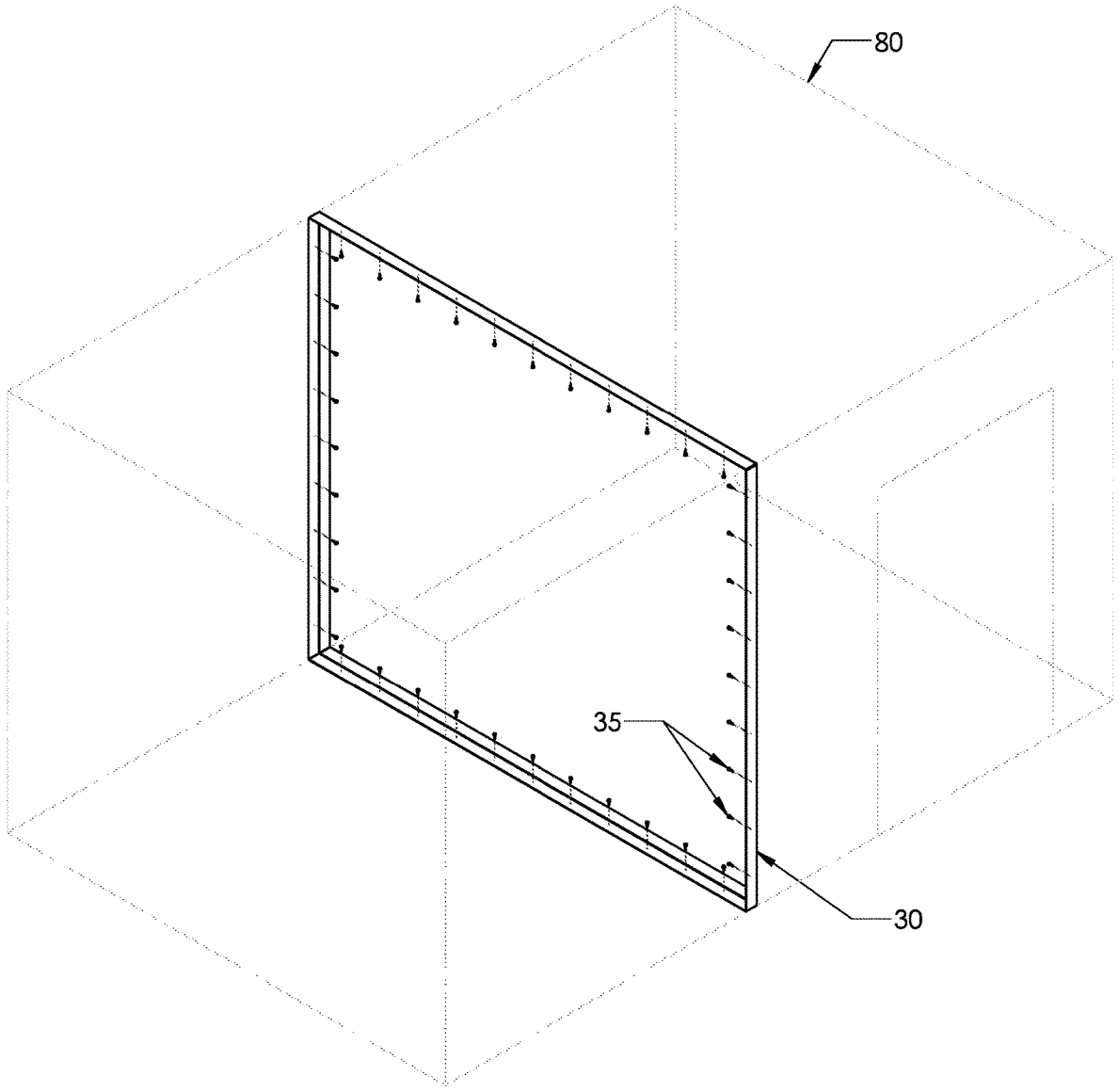
FIG. 9 is a partially exploded rear isometric view of a structural frame and a plurality of fasteners used to attach the structural frame to the cabinet of the air handling unit.

The modular bulkhead system 5 provides a modular bulkhead wall as well as a structural frame 30 or a transition frame 31. The structural frame 30 comprises a plurality of structural frame members. Each structural frame member of the plurality of structural frame members comprises a first leg and a second leg that are integrally attached to one another and form a substantially L-shaped cross-sectional profile. The first leg of each structural member attaches directly to an interior cabinet surface, as shown in FIG. 9. The second leg of each structural member provides a mounting surface that attaches to either the modular bulkhead wall or, alternatively, the transition frame 31, wherein the transition frame 31 attaches to the modular bulkhead wall and structural frame 30 or cabinet 80. The modular bulkhead wall is described herein as a first non-limiting exemplary embodiment and an alternate second non-limiting exemplary embodiment.

The first non-limiting exemplary embodiment of the modular bulkhead wall comprises a plurality of panels including at least one middle panel, a first side panel 10, and a second side panel 20. The middle panel(s) may comprise a fan panel 15 or a filler panel 25. The fan panel 15 is configured to support hanging attachment of one or more of the suspended fans 6.

The modular nature of the panels allows for various alternative bulkhead walls to be assembled to coordinate with each custom application. One example application is where the frame attachment along each side edge of the bulkhead wall provides sufficient vertical structural support to the side panels such that they do not require additional vertical stiffening support. The alternate second non-limiting exemplary embodiment of the modular bulkhead wall, shown schematically in FIG. 2A and FIG. 3A, comprises an alternative first side panel 110 and an alternative second side panel 120. Either one or both alternative side panels 110, 120, have one or more panel openings 8.

Figure 1:
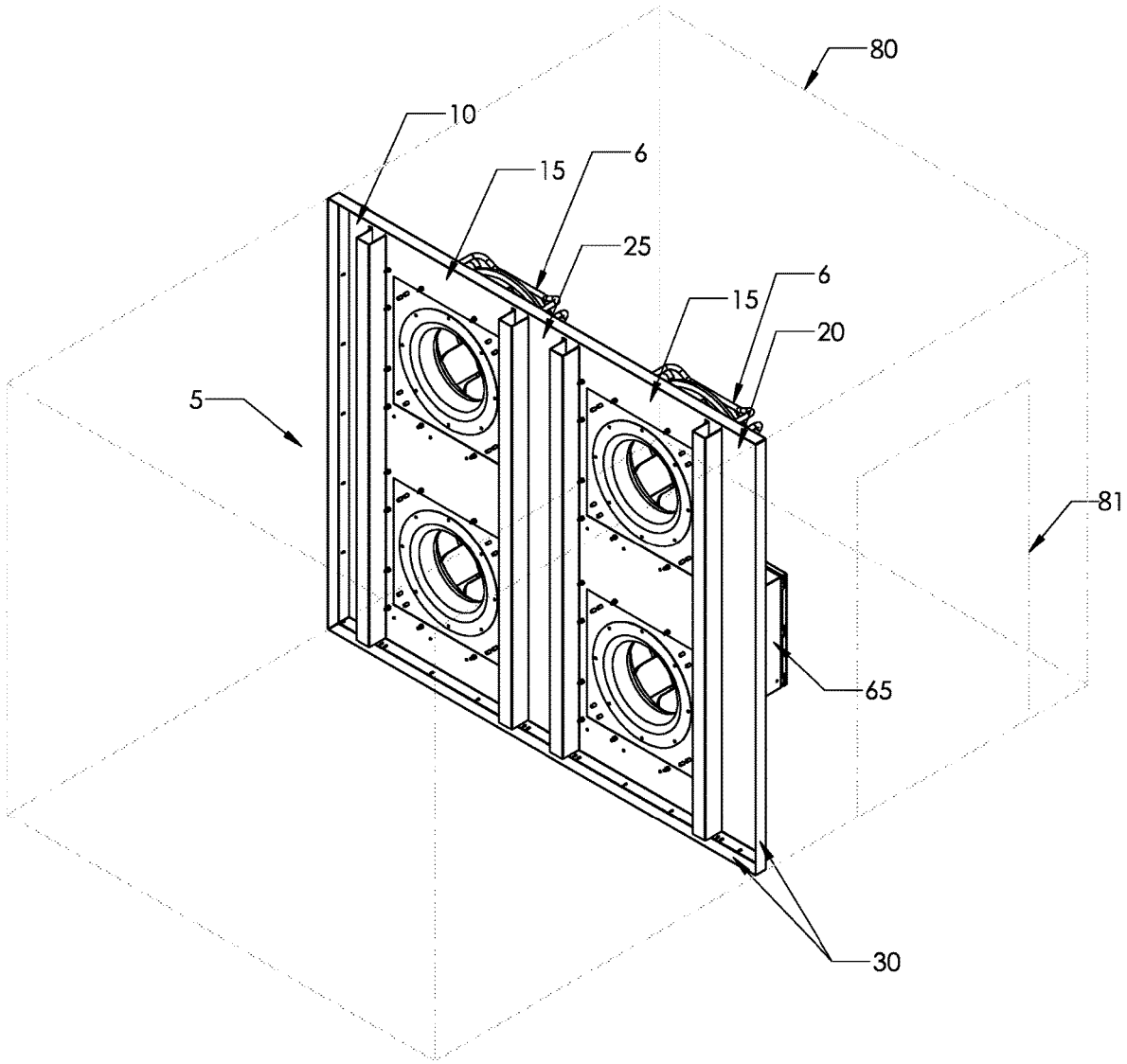
FIG. 1 is a rear isometric view of an exemplary embodiment of a modular bulkhead system installed within a cabinet of an air handling unit.
Figure 2:
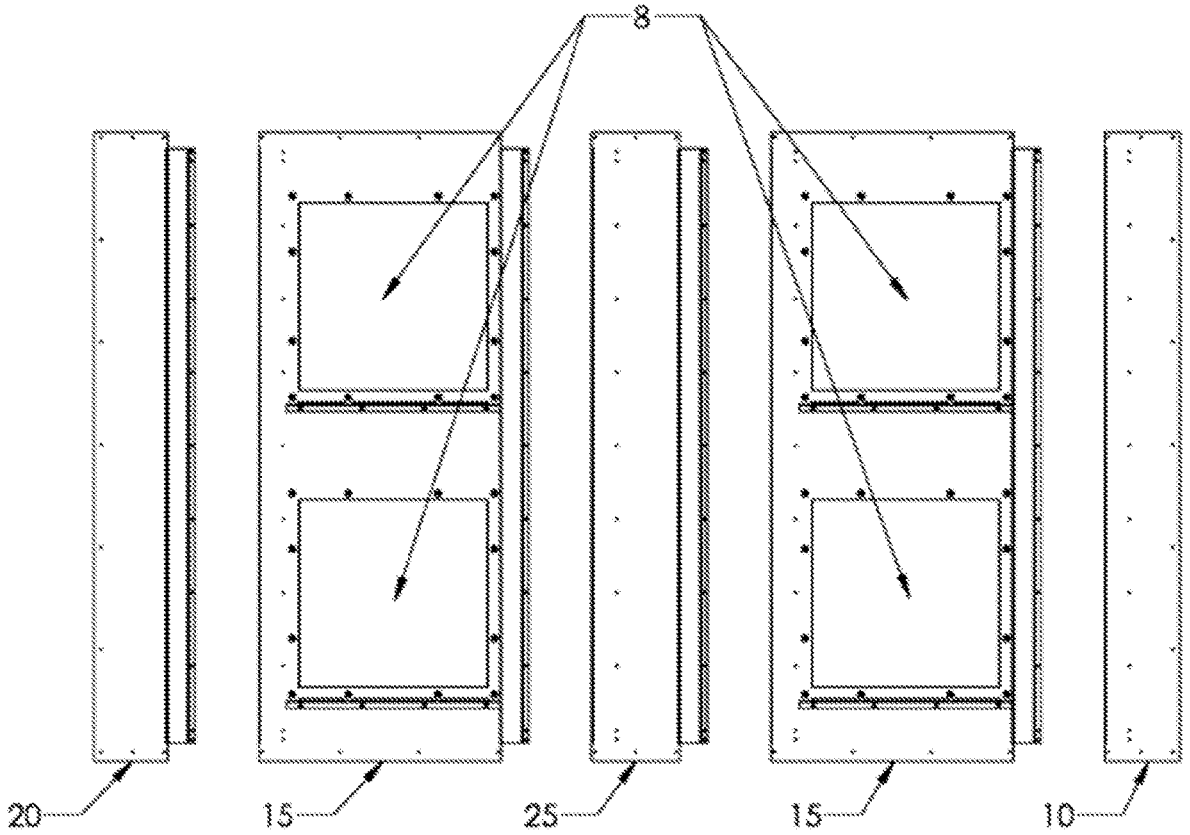
FIG. 2 is a front exploded view of an exemplary embodiment of a modular bulkhead wall of FIG. 1, comprising a first side panel, a second side panel, two fan panels, and a filler panel.
Figure 2A:
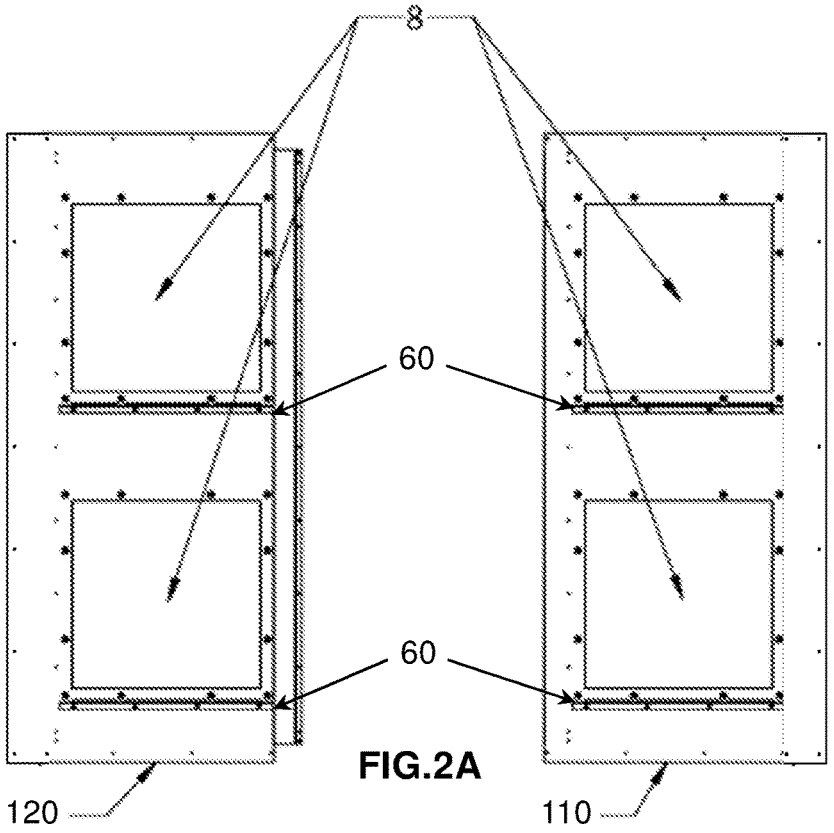
FIG. 2A is a front exploded view of another exemplary embodiment of a modular bulkhead wall, comprising an alternative first side panel and an alternative second side panel.

The first non-limiting exemplary modular bulkhead wall is represented in FIG. 1 wherein it comprises the first side panel 10, a plurality of fan panels 15, the second side panel 20, and the filler panel 25. Each fan panel 15 of the plurality of fan panels 15 provides a plurality of panel openings 8, as shown in FIG. 2. The size and profile of each panel opening 8 is customized to accommodate the particular suspended fan(s) 6 that will be mounted and installed via hanging attachment on the modular bulkhead wall. While the panel openings 8 shown in FIG. 2 comprise a substantially square profile, it is also anticipated that the panel openings 8 may take the form of any polygon or closed curved shape.

As described above and as shown in the FIGS. 2A and 3A, it is anticipated that one or more panel openings 8 may be provided in either one or both alternative side panels 110, 120. In an application with one or more middle panels as shown in FIG. 2 where the frame attachment at each side edge of the bulkhead wall provides sufficient structural support, one may substitute an alternative first side panel 110 in the position of the first side fan panel 10, and/or substitute an alternative side panel 120 in the position of the second fan panel 20.

Figure 3:
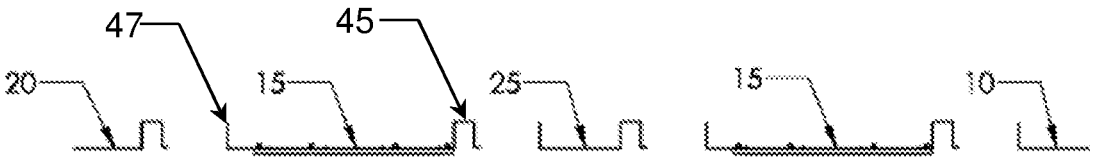
FIG. 3 is a top exploded view of the modular bulkhead wall of FIG. 2.
Figure 3A:
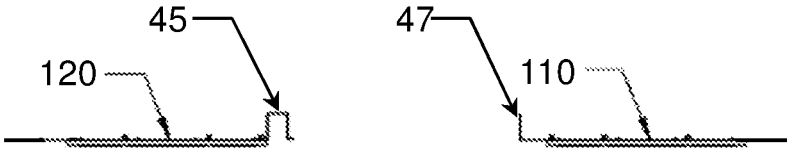
FIG. 3A is a top exploded view of the modular bulkhead wall of FIG. 2A.
Figure 7:
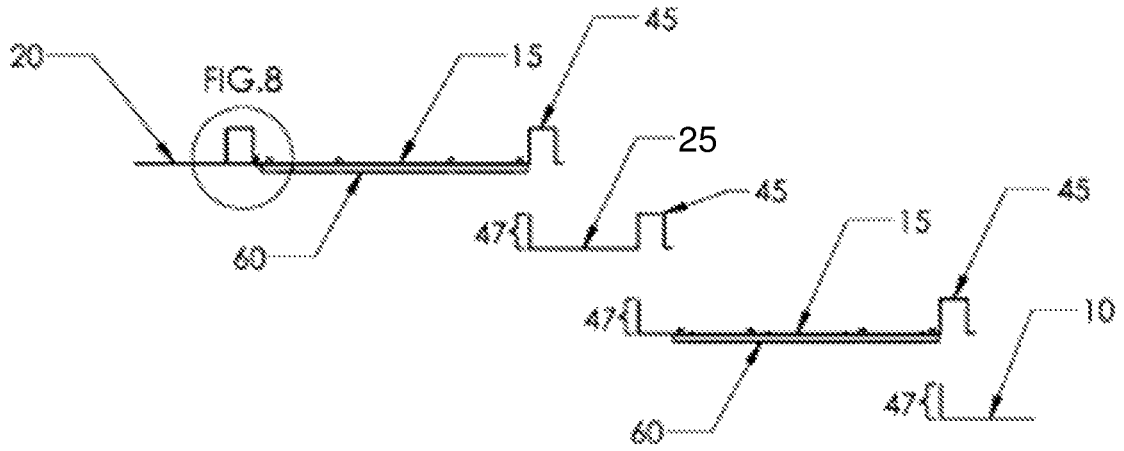
FIG. 7 is a partially exploded top view of the modular bulkhead wall of FIG. 2 where a fan panel is attached to the second side panel.

Each panel provided by the modular bulkhead wall provides either a c-channel 45, a stiffening flange 47, or both. Additionally, the first side panel 10 provides one stiffening flange 47, the second side panel 20 provides one c-channel 45, and the fan panel 15 and filler panel 25 each provide one stiffening flange 47 and one c-channel 45, as shown in FIGS. 3 and 7.

Figure 4:
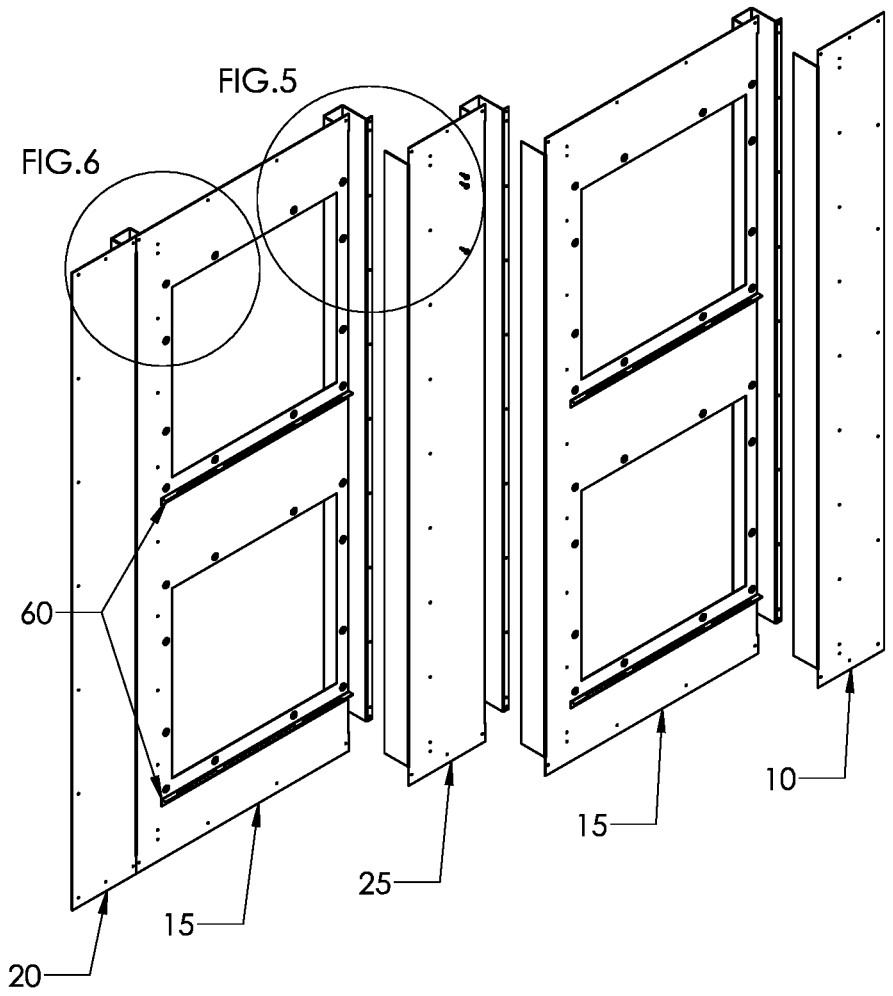
FIG. 4 is a partially exploded front isometric view of the modular bulkhead wall of FIG. 1.
Figure 20:
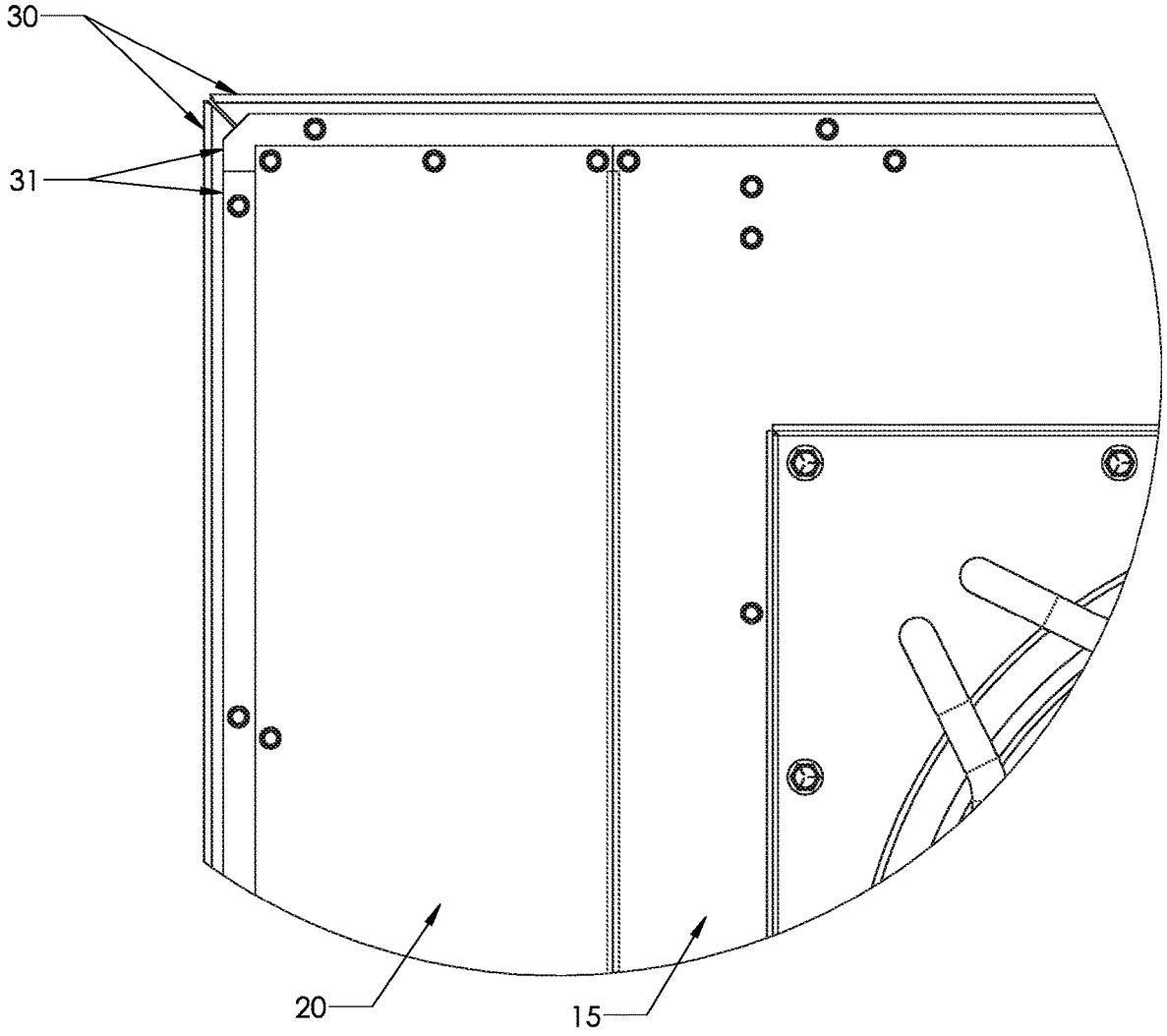
FIG. 20 is an enlarged front view from FIG. 18 showing the second side panel and one of the fan panels attached to the transition frame that is attached to the structural frame.
Figure 21:
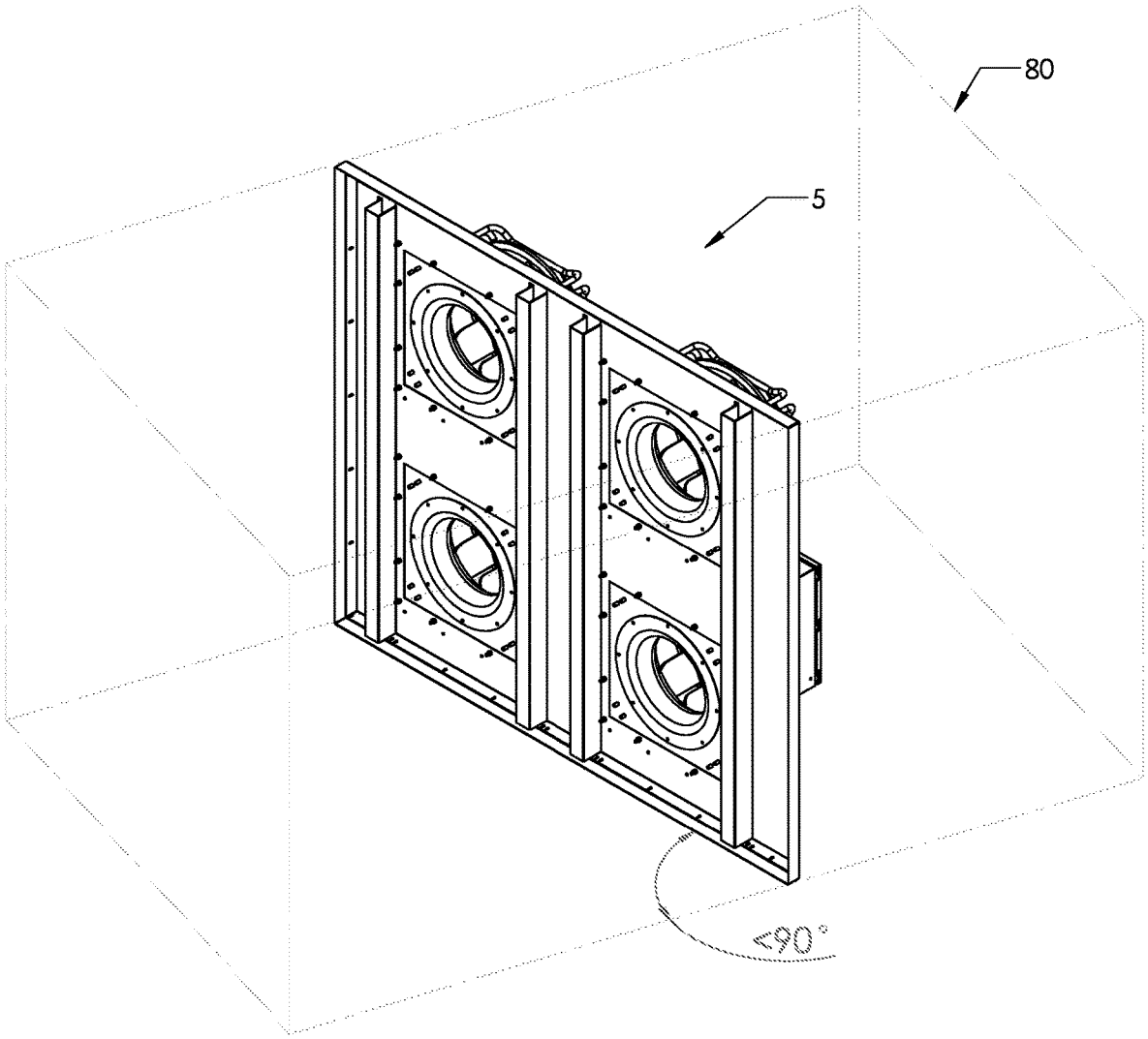
FIG. 21 is rear isometric view of the modular bulkhead system installed at a skewed angle relative to the walls of the cabinet of the air handling unit.
Figure 22:
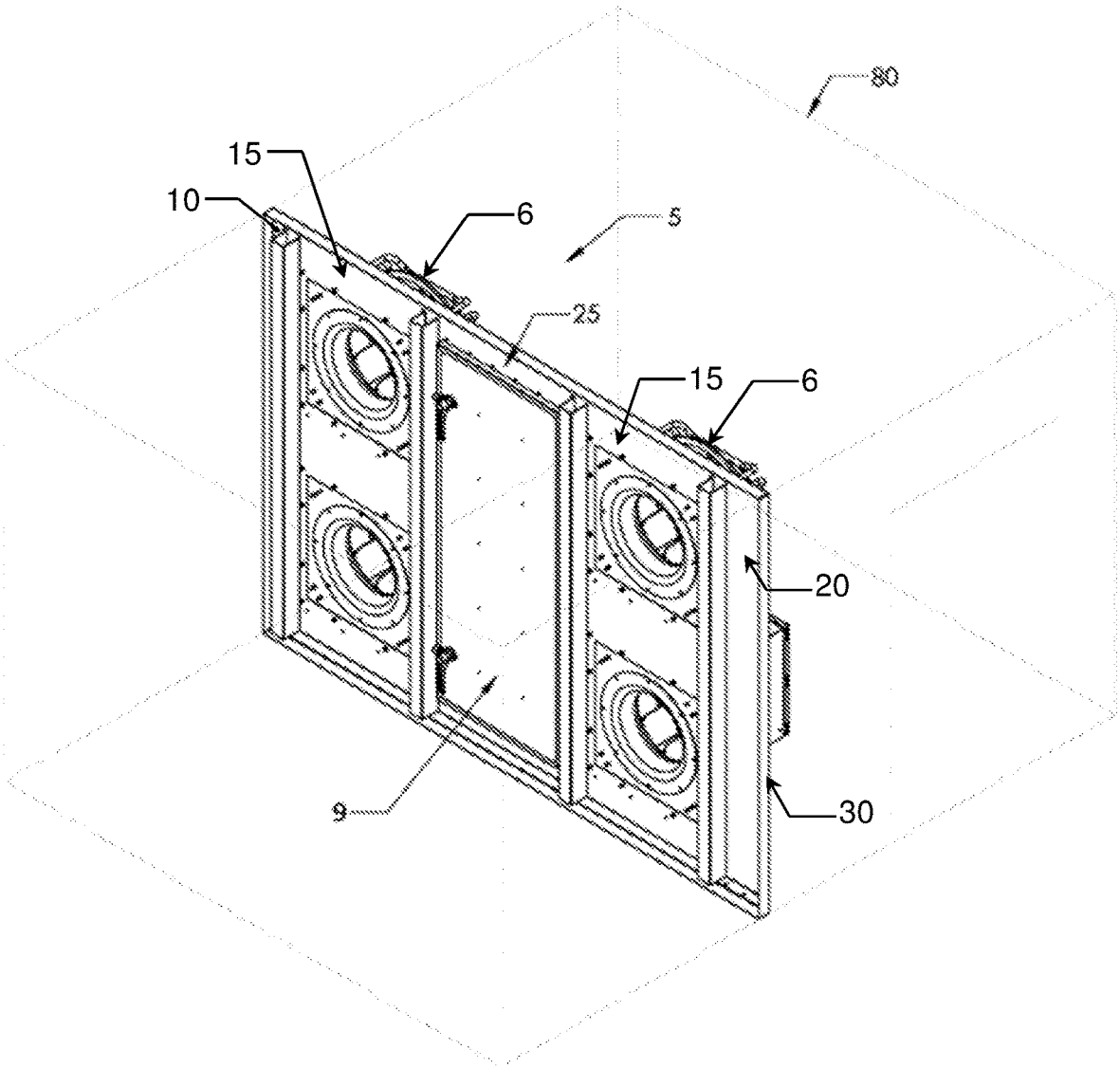
FIG. 22 is a rear isometric view of an alternative modular bulkhead system showing a modular bulkhead wall which includes a filler panel configured as a filler door panel and provides a bulkhead door for access to the front and back sides of the modular bulkhead wall, with the filler door panel attached to a fan panel on one side and attached to a side fan panel on the opposing side.

Further, as best seen in FIGS. 2, 4 and 20, the first side panel 10 and the second side panel 20 each include a vertical interlocking edge (configured for interlocking and attachment with an adjacent panel) and an opposing vertical connection edge (configured for connection to the structural frame 30 or to the transition frame 31). The vertical connection edges may provide a frame attachment end with pre-punched holes 40 along their front vertical edge (see also FIG. 16). Also, the filler panel 25, first side panel 10, or second side panel 20 may be customized and configured to include a bulkhead door 9 that allows for access or entry to the back side of the modular bulkhead wall, as shown in FIG. 22. In FIG. 22, the customized filler panel is shown with a bulkhead door 9. The bulkhead door 9 provides door handles on both its front and back sides. While it is not shown in the Figures, it is also anticipated that one or more bulkhead doors 9 may be attached to a first side panel 10 or attached to a second side door panel 20 of the modular bulkhead wall.

The modular nature of the panels provides for further alternatives to be assembled to meet the custom requirements of each application. For example, in the modular bulkhead wall depicted in FIG. 22, one may remove the filler door panel 25 and substitute an additional fan panel 15.

Figure 5:
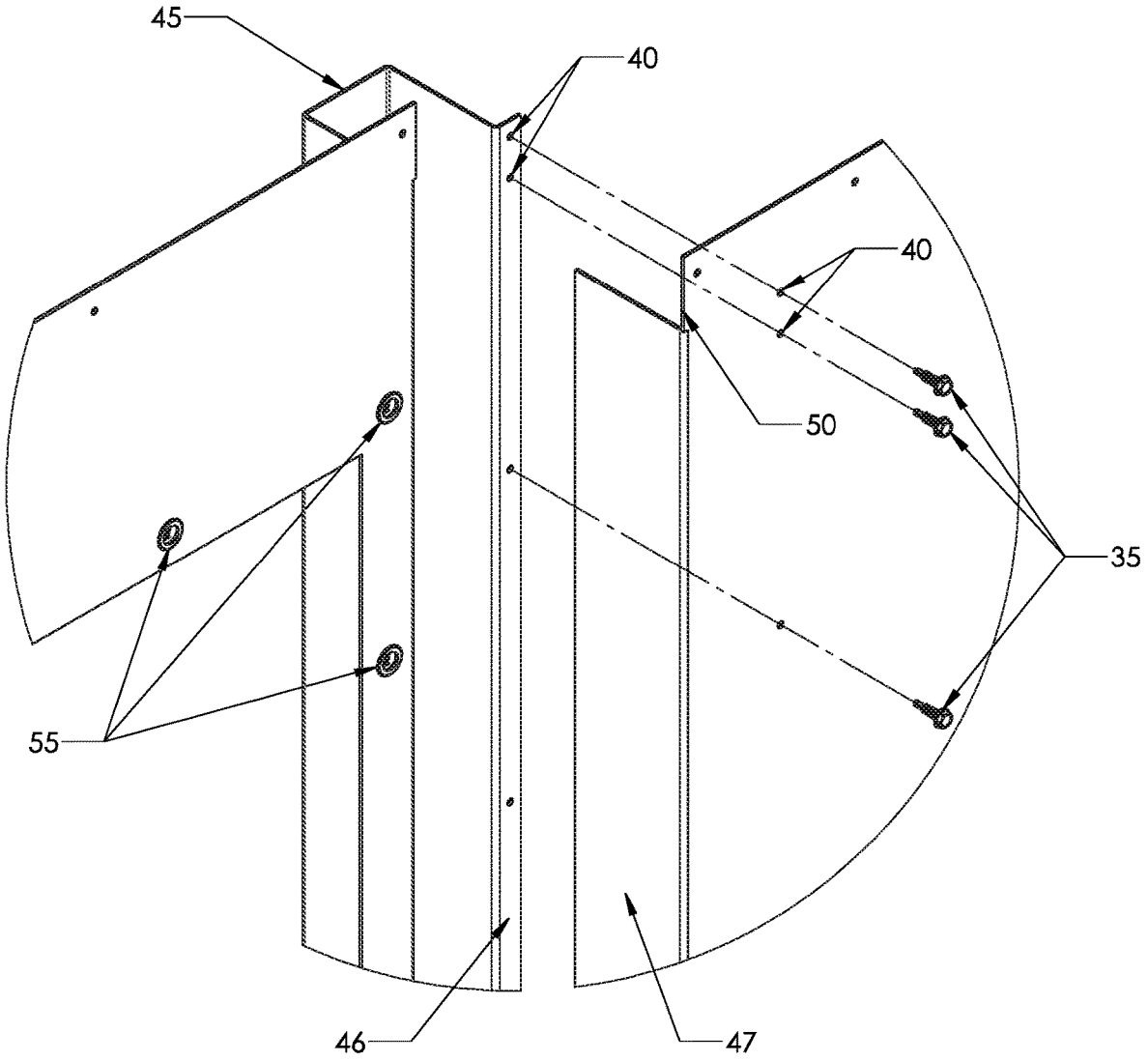
FIG. 5 is an enlarged, exploded, front isometric view showing a c-channel and an outwardly extending c-channel lip of one panel and a stiffening element of another panel.
Figure 8:
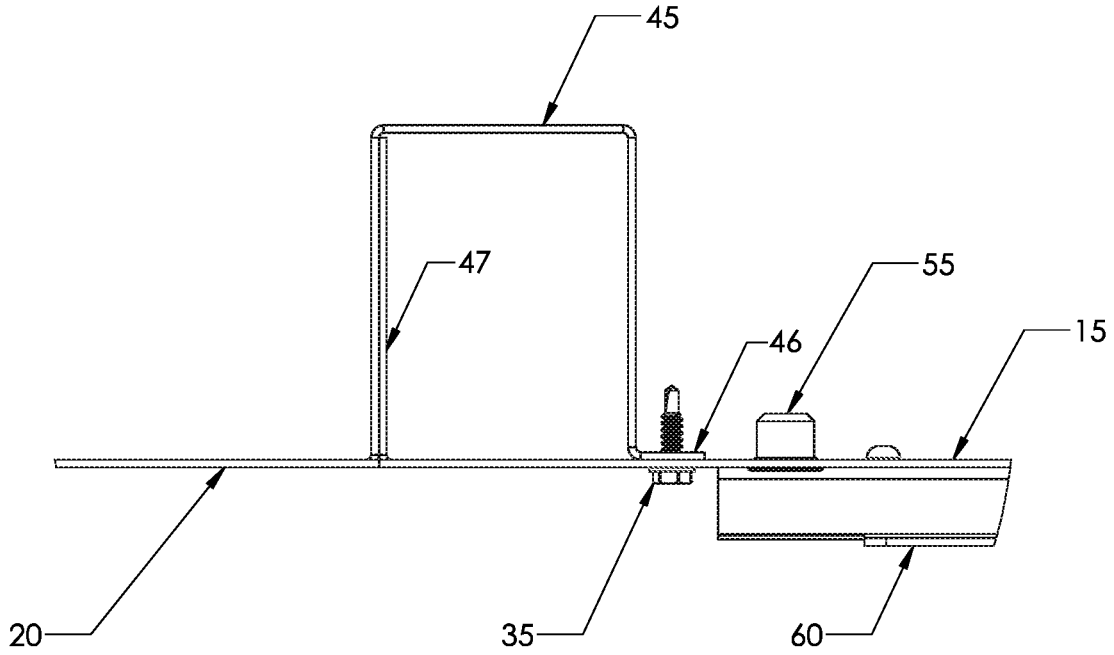
FIG. 8 is an enlarged top view of the connection between the fan panel and the second side panel shown in FIG. 7, wherein the c-channel lip provided by the c-channel of the second side panel is attached to the fan panel with a fastener.
Figure 10:
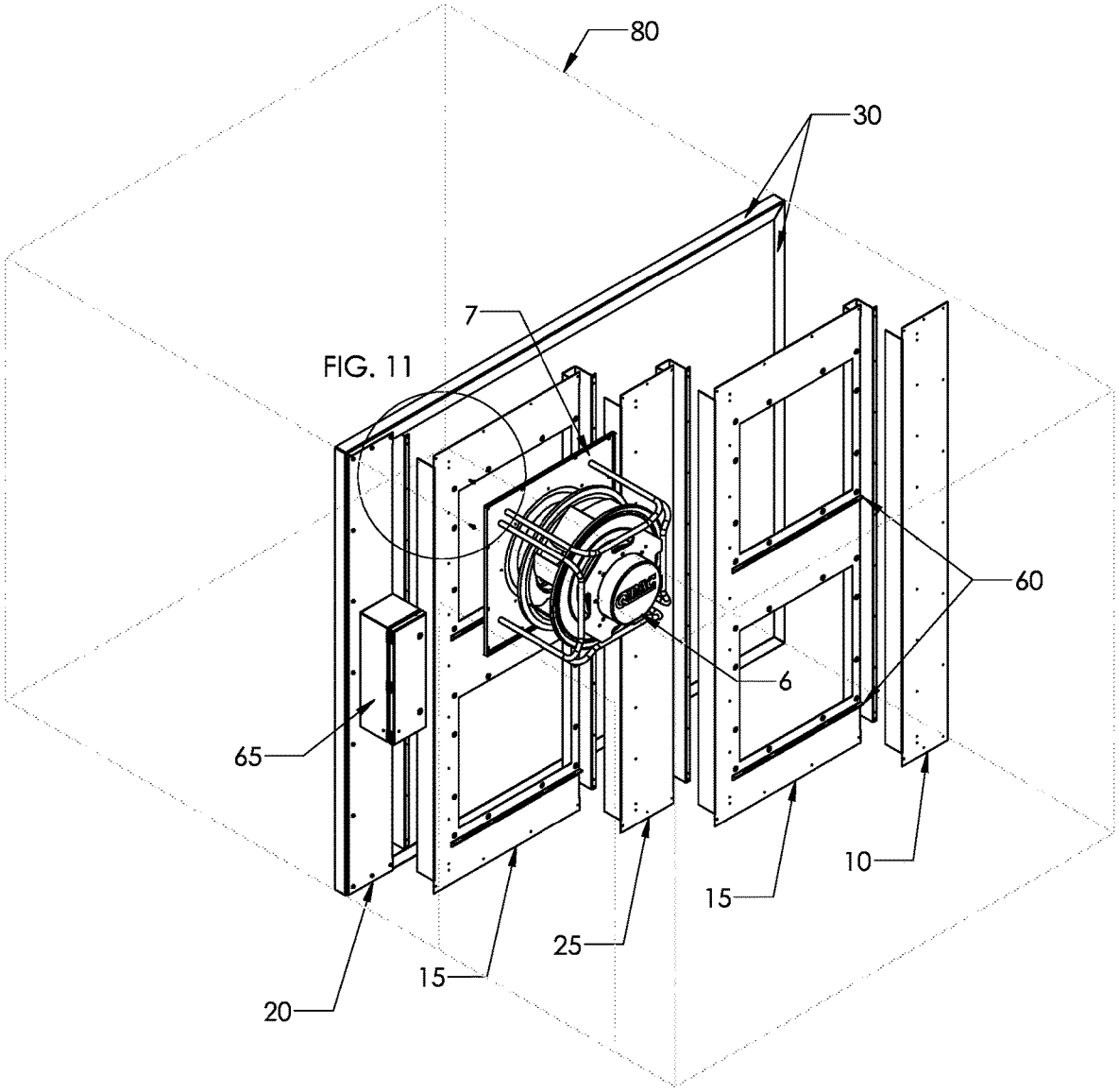
FIG. 10 is a partially exploded front isometric view of the modular bulkhead wall, the structural frame, a fan, and a quick-connect box that is attached to the second side panel of the modular bulkhead wall of FIG. 2.
Figure 11:
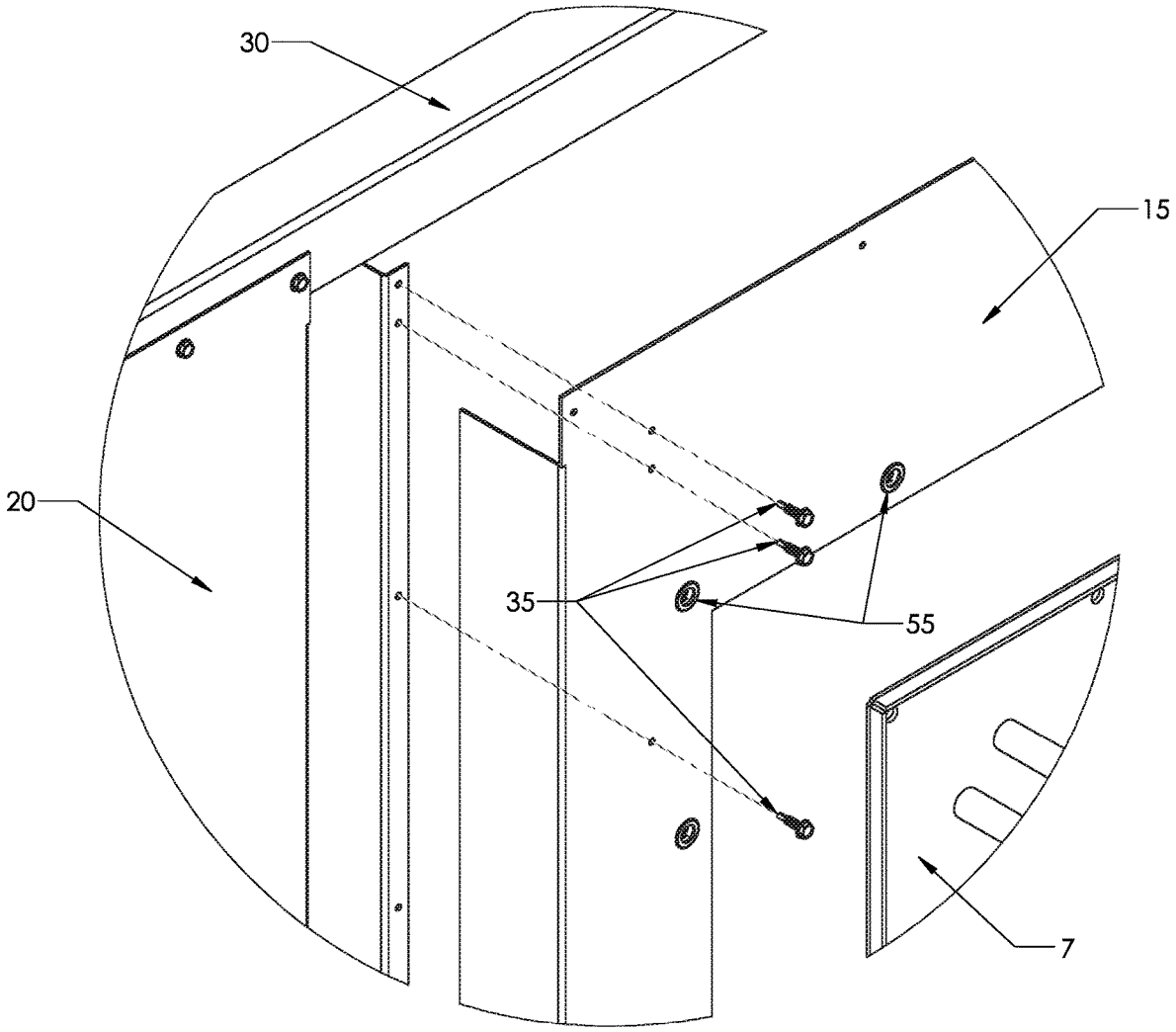
FIG. 11 is an enlarged, partially exploded, front isometric view showing the second side panel attached to the structural frame and how the plurality of fasteners are inserted through the fan panel and into the c-channel lip of the second side panel, thereby attaching the two panels to one another.
Figure 12:
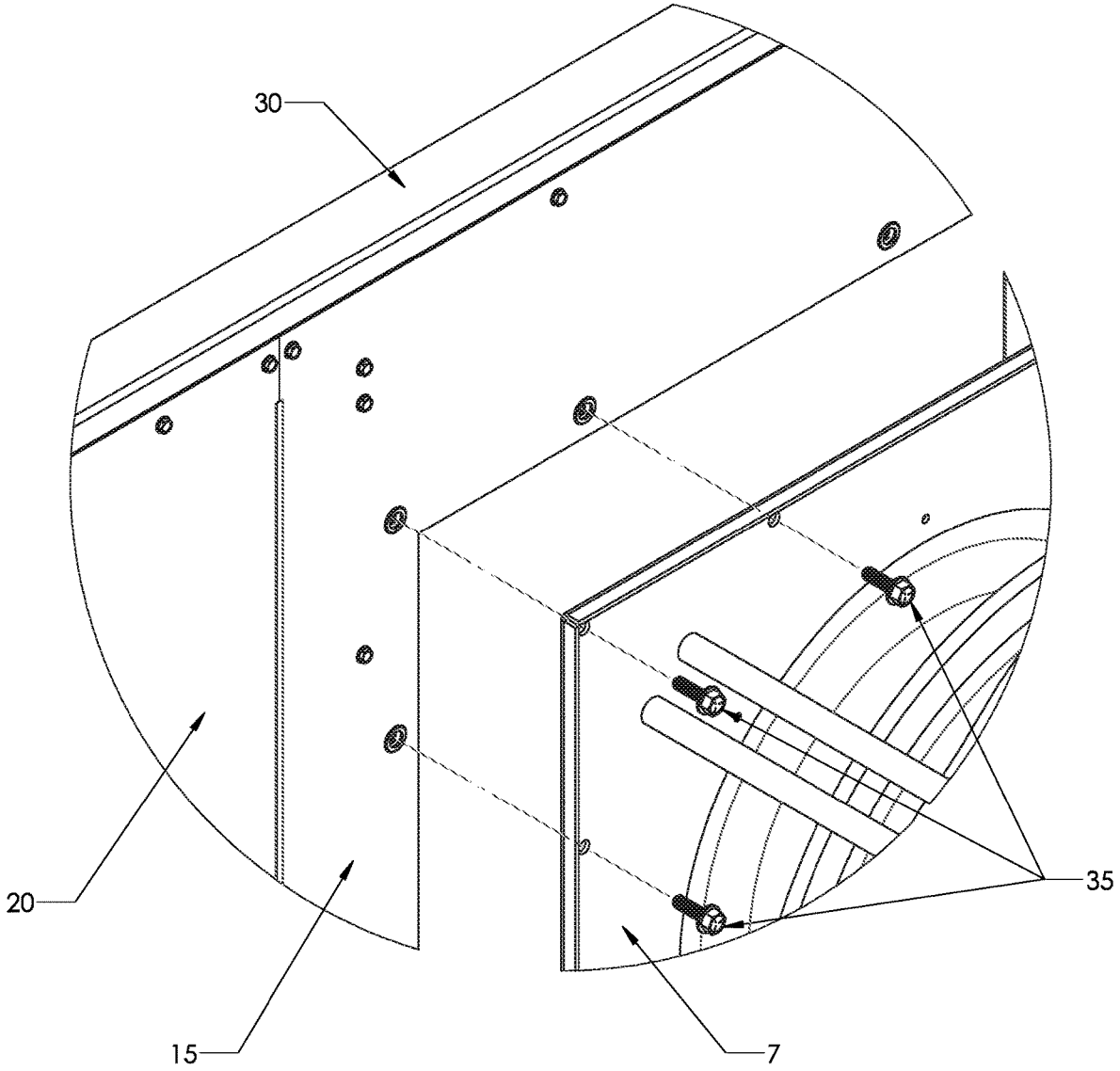
FIG. 12 is an enlarged, partially exploded, front isometric view showing the fan panel and the second side panel attached to one another as well as the structural frame and additionally a plurality of fasteners used to attach the fan to the fan panel.
Figure 16:
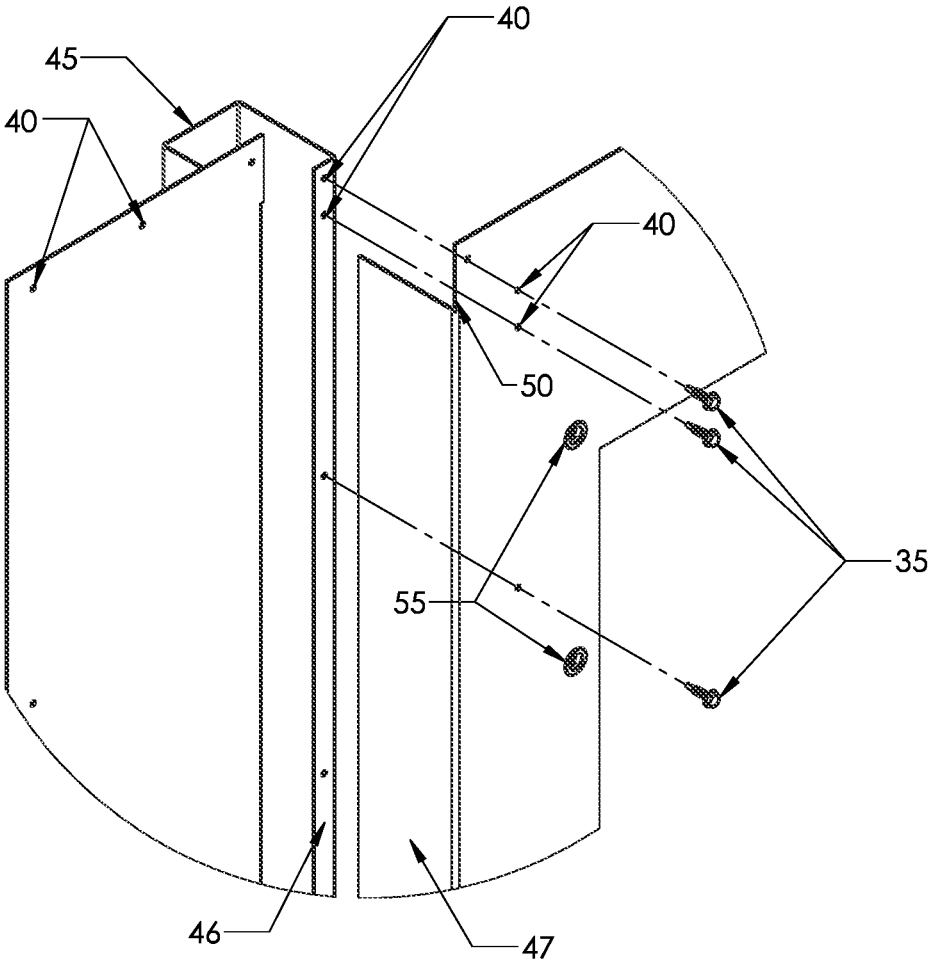
FIG. 16 is an enlarged, exploded, front isometric view showing a c-channel and an inwardly extending c-channel lip of one panel and a stiffening element of another panel.
Figure 17:
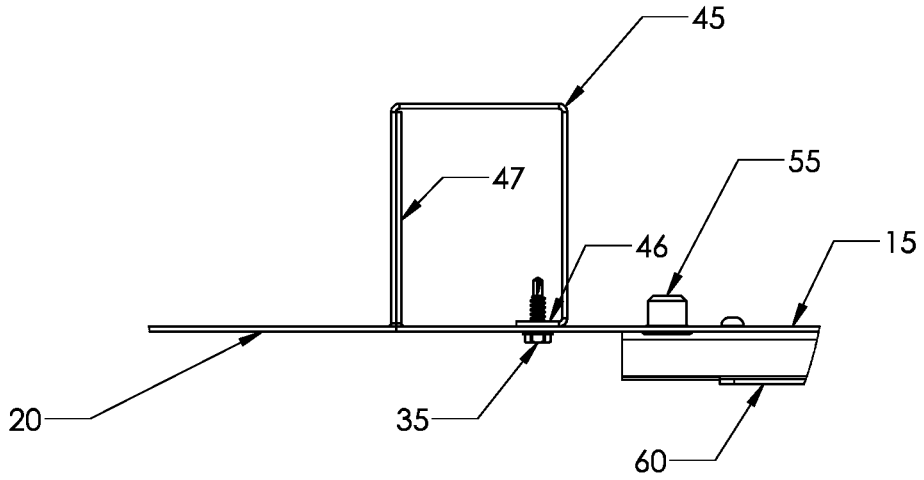
FIG. 17 is an enlarged top view showing a c-channel and an inverted c-channel lip of one panel connected to an adjacent fan panel.

The c-channel 45 and stiffening flange 47 are integrally attached to the panels which they are respectively provided by. The c-channel 45 and the stiffening flange 47 each respectively span from substantially the top of the modular bulkhead wall to substantially the bottom of the modular bulkhead wall, as shown in FIG. 10. The c-channel 45 provides an attachment surface for connecting to an adjacent panel. Referring to FIGS. 5 and 8, the attachment surface provided by the c-channel 45 comprises a c-channel lip 46. The c-channel lip 46 may either extend outward respective to the c-channel 45, as shown in FIG. 5, or inward respective to the c-channel 45, as shown in FIG. 16. The c-channel lip 46 provides a plurality of pre-punched holes 40 for ease of installation as well as increasing accurate and precise attachment of adjacent panels to each other.

Installation of the modular bulkhead system 5 requires the plurality of structural frame members of the structural frame 30 to be attached to interior surfaces within the cabinet 80. The structural frame 30 is preferably affixed to the cabinet 80 with a plurality of fasteners 35, as shown in FIG. 9. However, it is also anticipated that other methods of attachment may be used to affix the structural frame 30 to the cabinet 80. Once the first leg of the structural frame 30 is attached to the cabinet 80, the second leg of the structural frame 30 can be attached directly to the modular bulkhead wall.

Figure 13:
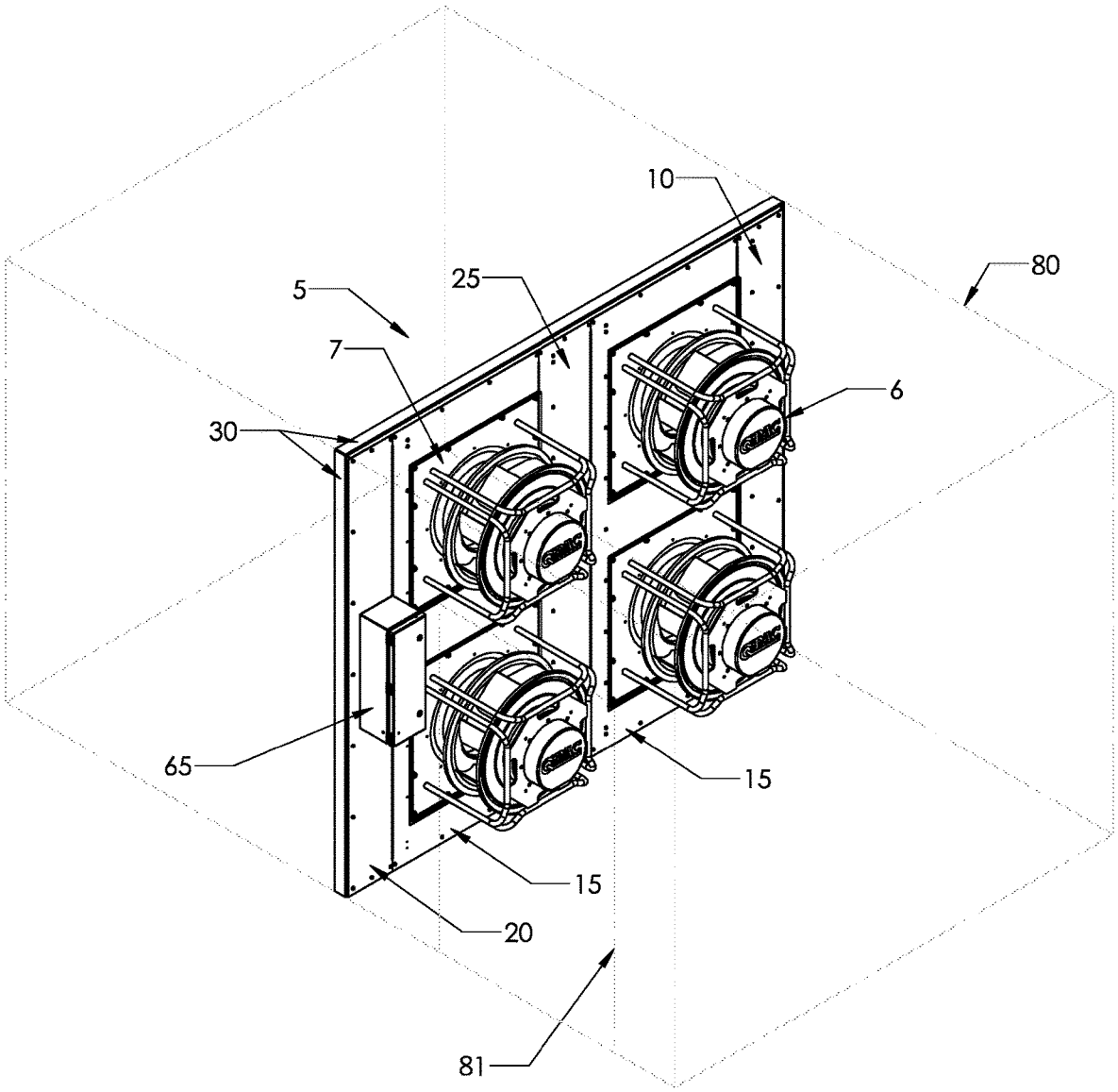
FIG. 13 is a front isometric view of FIG. 1 showing the modular bulkhead system installed within the cabinet of the air handling unit.
Figure 14:
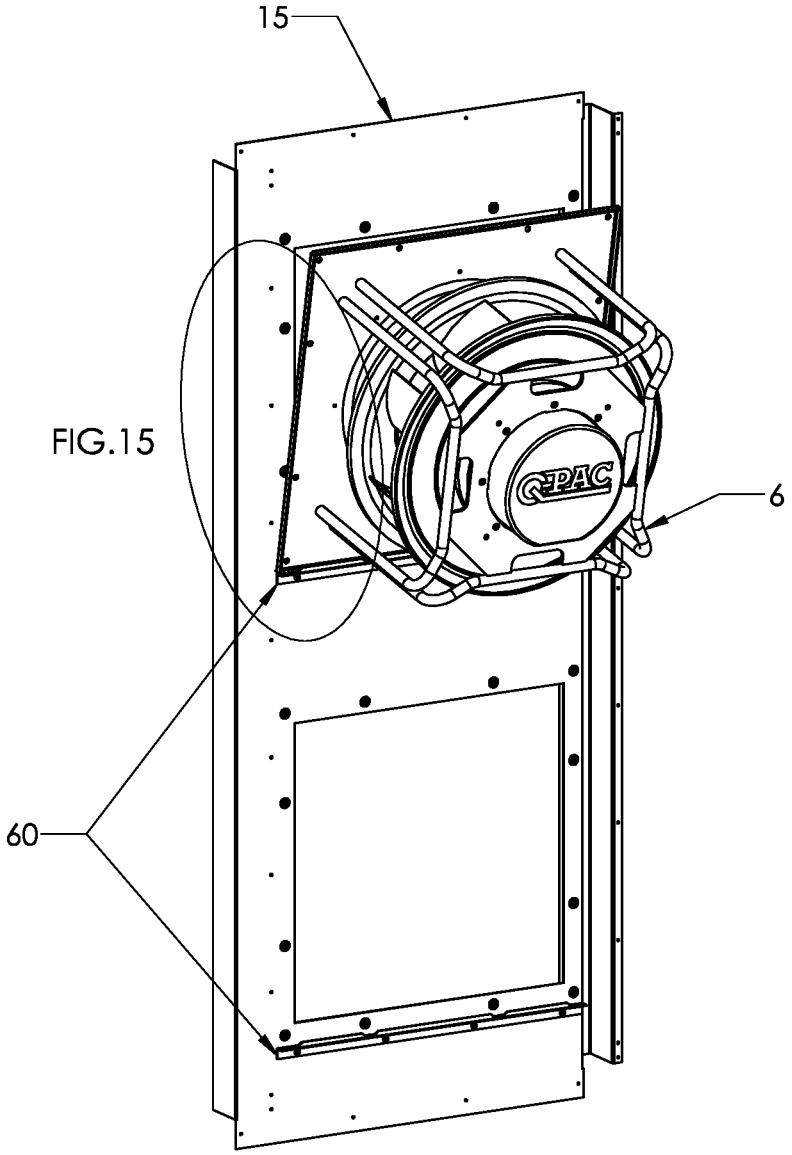
FIG. 14 is a front isometric view of a fan panel with a fan plate provided by a fan bearing on a ledge provided below the bottom edge of the top panel opening of the fan panel.
Figure 18:
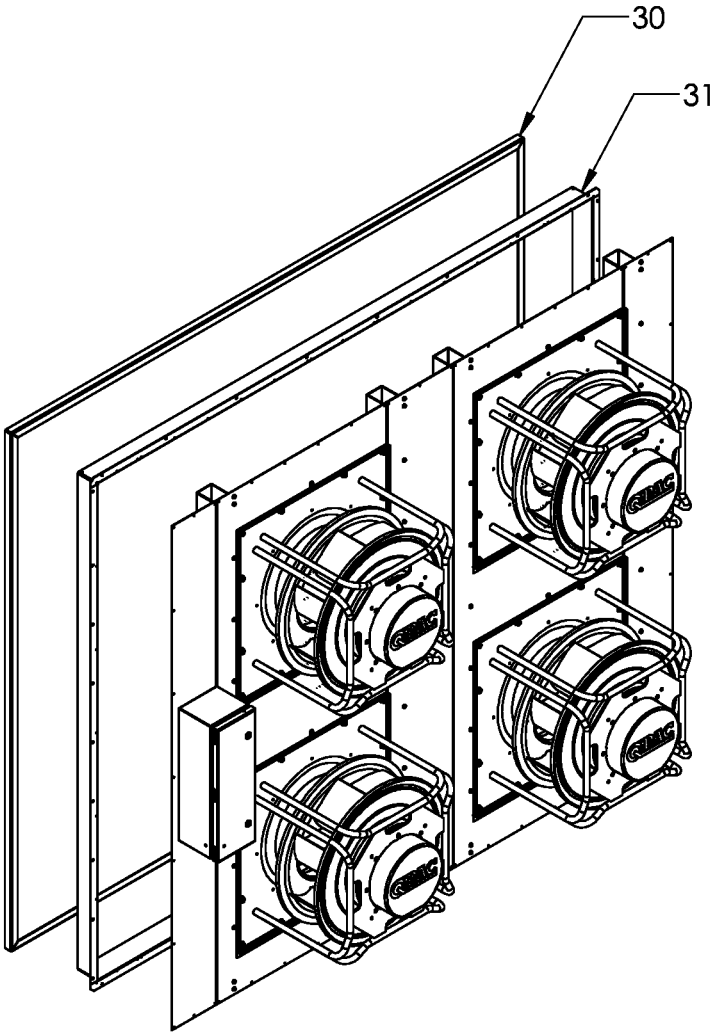
FIG. 18 is an exploded front isometric view showing the structural frame, a transition frame, and the modular bulkhead wall attached to a plurality of fans and the quick-connect box.
Figure 19:
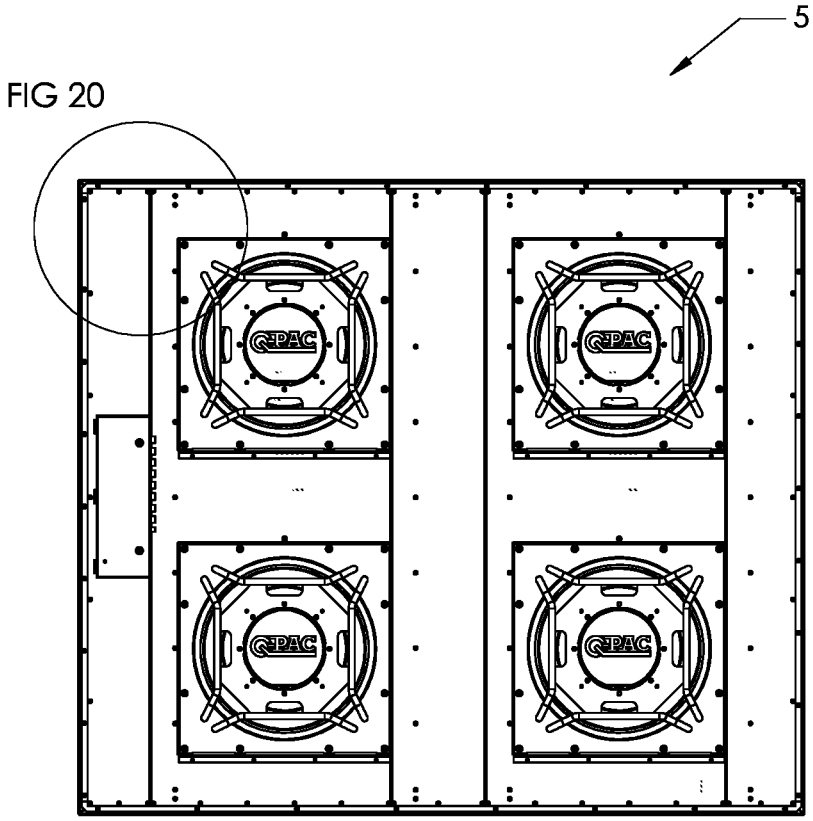
FIG. 19 is a front view showing the plurality of fans and a quick-connect box attached to the modular bulkhead wall which is attached to the transition frame which is attached to the structural frame.

When retrofitting the modular bulkhead system 5 within an already existing air handling unit, the modular bulkhead wall attaches directly to the structural frame 30, as shown in FIGS. 1 and 13, and the structural frame 30 is attached the cabinet 80. However, it is alternatively anticipated that the modular bulkhead system 5 could provide a transition frame 31 to connect the modular bulkhead wall to the structural frame 30 indirectly, as shown in FIG. 18. Furthermore, when the modular bulkhead system 5 is installed within an air handling unit during its original manufacture, it is preferable that a transition frame 31 be used to indirectly attach the modular bulkhead wall to the structural frame 30.

The transition frame 31 comprises a plurality of transition frame members. Each transition frame member of the plurality of transition frame members provides a first flange and a second flange. The first flange and second flange are integrally attached to each other and provide a substantially L-shaped cross-sectional profile. The first flanges of the transition frame 31 are substantially parallel to the first legs of the structural frame 30. The second flanges of the transition frame 31 attach to both the modular bulkhead wall and the second legs of the structural frame 30, as shown in FIG. 20. While the method of attachment used to attach the transition frame 31 to the structural frame 30 and modular bulkhead wall are not limited to the use of fasteners, it is preferable that the second flanges of the transition frame 31 attach to the modular bulkhead wall with a first plurality of fasteners 35 and separately to the second legs of the structural frame 30 with a second plurality of fasteners 35.

The transition frame 31 offers additional installation tolerances that are not afforded when directly connecting the bulkhead wall to the structural frame 30. Additionally, some installations of the modular bulkhead system 5 allow for the modular bulkhead wall to be preassembled prior to transporting the modular bulkhead wall to the air handling unit that it will be installed within. As such, attaching a transition frame 31 to a preassembled modular bulkhead wall prior to transporting the preassembled modular bulkhead wall offers several benefits, such as improved structural rigidity of the preassembled modular bulkhead wall during transport as well as improved efficiency during installation of the modular bulkhead system 5 within the cabinet 80. Furthermore, when the modular bulkhead system 5 is installed within new air handling units during their original equipment manufacturer, preassembling the modular bulkhead wall with the transition frame 31 allows the installer to use a crane to lift and set the modular bulkhead wall within the new air handling unit without damaging the modular bulkhead wall.

Figure 6:
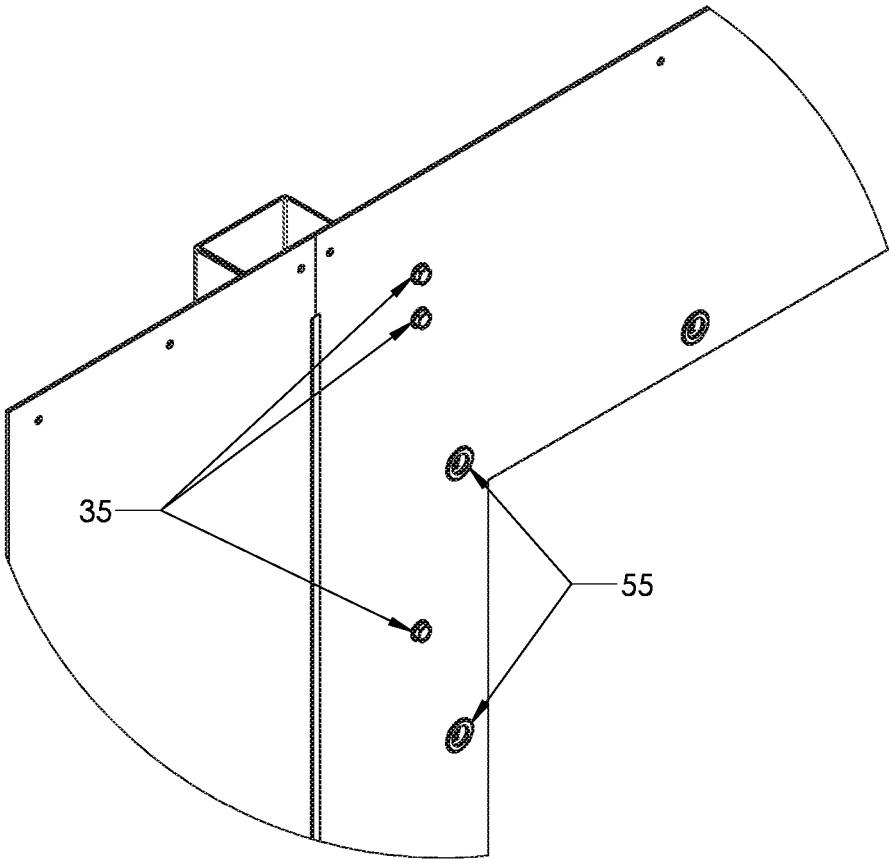
FIG. 6 is an enlarged front isometric view showing two adjacent panels being attached to one another with a plurality of fasteners that are each inserted through the front side of one panel and into a c-channel lip of the other panel.

Adjacent panels within the modular bulkhead wall are attached to each other by interlocking the stiffening flange 47 of one panel against an interior side of the c-channel 45 of the other panel, as shown in FIG. 8. The interlocking configuration forms an intermediate bulkhead stiffening element that comprises a polygonal tubular profile, as shown in FIG. 8. The interlocking configuration also allows a plurality of pre-punched holes 40 provided by each of the two adjacent panels to become substantially aligned such that a plurality of fasteners 35 can be driven through the aligned pre-punched holes 40 to affix the two adjacent panels to each other, as shown in FIGS. 5, 6, and 8.

For example, as shown in FIG. 5, the stiffening flange 47 of the fan panel 15 is inserted into the c-channel 45 of the filler panel 25. The stiffening flange 47 of the filler panel 25 interlocks with the c-channel 45 of the fan panel 15 such that the backside of the filler panel 25 substantially closes the c-channel 45 to form a tubular intermediate bulkhead stiffening element. The formation of the tubular intermediate bulkhead stiffening element by two adjacent panels also assists with aligning the two adjacent panels such that they can be efficiently affixed to each other. For example, as also shown in FIG. 5, the c-channel lip 46 of the fan panel 15 is positioned such that upon interlocking the fan panel 15 with the filler panel 25 the plurality of pre-punched holes provided by the c-channel lip 46 are substantially aligned with a plurality of pre-punched holes provided by the filler panel 25. Subsequently, a third plurality of fasteners 35 are then driven from the front side of the fan panel 15, thereby simultaneously securing the fan panel 15 and filler panel 25 to each other while also forming the tubular intermediate bulkhead stiffening element.

The intermediate bulkhead stiffening element comprises a polygonal tubular profile that provides structural support for the bulkhead wall substantially where the fan panel 15 and filler panel 25 meet. The intermediate bulkhead stiffening element increases the stability of the modular bulkhead wall and as such, is critical to the successful performance of the modular bulkhead wall. The modular bulkhead wall must adequately resist various static and dynamic forces, including differential pressures resulting on the front and back sides of the modular bulkhead wall during the operation of the air handling unit's fan system. While the intermediate bulkhead stiffening elements shown in the Figures as having a substantially quadrilateral cross-sectional profile, it is also anticipated that alternative embodiments of the modular bulkhead system 5 may provide intermediate bulkhead stiffening element(s) of other polygonal cross-sectional profiles.

Although it is anticipated that the modular bulkhead wall does not always require a filler panel 25, its use increases the stability of the modular bulkhead wall because its inclusion provides an additional intermediate bulkhead stiffening element, which increases the stiffness of the modular bulkhead wall.

Once the modular bulkhead wall is installed within the cabinet 80, one or more fans 6 may then be securely attached and hung on the modular bulkhead wall. The bulkhead wall provides support for the suspension of the fans by attachment adjacent to the perimeter of each opening 8. Each fan 6 provides a fan plate 7 that is integrally attached to the fan 6. The fan plate 7 comprises a substantially flat plate that is further comprised by a plurality of sides, of which include a bottom side. The fan plate 7 is configured to support suspension of the fan 6.

Figure 15:
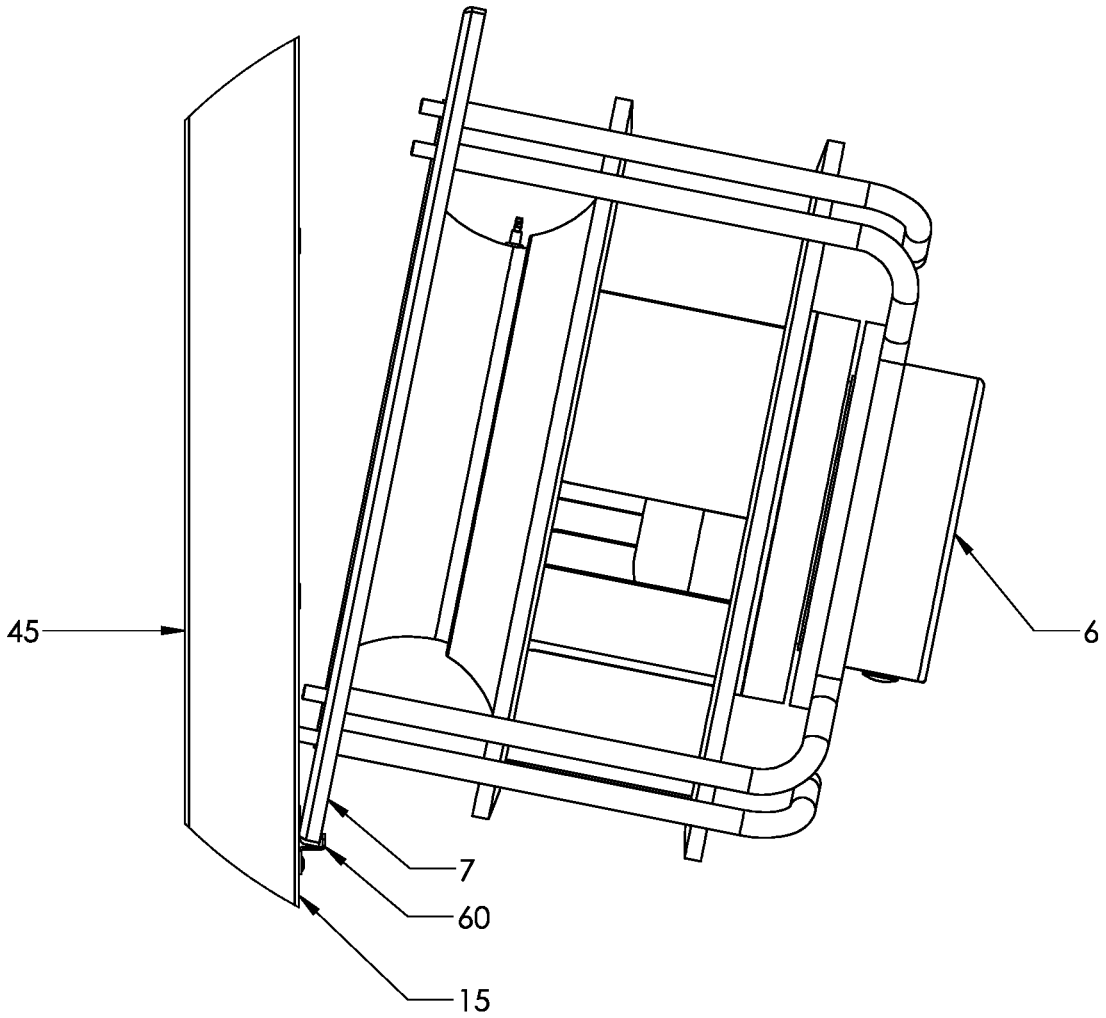
FIG. 15 is an enlarged side view from FIG. 14 showing the bottom edge of the fan plate bearing on the ledge.

Each panel opening 8 provides a ledge 60 below its bottom edge, as shown in FIG. 4. Because space within the cabinet 80 is limited, the modular bulkhead system 5 is designed to allow one individual to install the entire system within the cabinet 80. It is important for one person to also be capable of attaching the new fan array onto the modular bulkhead wall safely. The ledge 60 is configured for initial bearing support of the fan 6. Accordingly, the ledge 60 allows the installer to lift and temporarily support the fan 6 by setting the bottom side of the fan plate 7 on the ledge 60, as shown in FIG. 15. While the bottom side of the fan plate 7 temporarily bears on the ledge 60 the installer can conveniently pivot the fan 6 about the ledge 60 towards the respective panel and subsequently attach the fan plate 7 to the modular bulkhead wall using a fourth plurality of fasteners 35 and nut inserts 55. This is particularly useful for overhead installations of one or more fans 6.

The modular bulkhead system 5 also supports a quick-connect box 65, which is used to power and control the one or more fans 6. The quick-connect box 65 is electronically coupled to each fan 6 using a plurality of fan wires. It is anticipated that a plurality pre-punched holes 40, or indicators for points of attachment, could be provided on the modular bulkhead wall to improve the efficiency of the installation of the fan wires.

While the embodiments of the invention have been disclosed, certain modifications may be made by those skilled in the art to modify the invention without departing from the spirit of the invention.

The invention claimed is:

1. An HVAC modular bulkhead system for support of one or more suspended fans comprising:
- a modular bulkhead wall;
- wherein the modular bulkhead wall further comprises an alternative first side panel and an alternative second side panel;
- wherein the alternative first side panel has a front surface and a back surface;
- wherein attached to one end of the alternative first side panel is a stiffening flange;
- wherein the alternative second side panel has a front surface and back surface;
- wherein attached to one end of the alternative second side panel is a c-channel;
- wherein the c-channel provides an attachment surface;
- wherein the stiffening flange of the alternative first side panel is interlocked with the c-channel of the alternative second side panel;
- wherein the alternative first side panel and alternative second side panel are attached to each other such that the front surfaces of each adjacent panel are aligned colinear;
- wherein a plurality of fasteners attaches the alternative first side panel to the attachment surface provided by the c-channel;
- wherein attachment of the alternative first side panel and the alternative second side panel forms a tubular intermediate bulkhead stiffening element;
- wherein each of the alternative first side panel and the alternative second side panel provides at least one panel opening;
- wherein a ledge is provided beneath the at least one panel opening of each of the alternative first side panel and the alternative second side panel;
- wherein the ledge provides a temporary bearing support for a pivotable rotation of a suspended fan;
- wherein the one or more suspended fan are hung on the modular bulkhead wall.

2. The modular bulkhead system of claim 1, wherein the alternative first side panel and the alternative second side panel are configured for attachment to a structural frame disposed at the periphery of the modular bulkhead wall.

3. The modular bulkhead system of claim 1, wherein the alternative first side panel and the alternative second side panel are configured for attachment to a transition frame disposed at the periphery of the modular bulkhead wall.

4. The modular bulkhead system of claim 1, wherein a quick-connect box is attached.

5. The modular bulkhead system of claim 1, wherein the c-channel attachment surface is a c-channel lip.

6. An HVAC modular bulkhead system comprising:
- a modular bulkhead wall;
- wherein the modular bulkhead wall further comprises a first side panel, a second side panel, and at least one middle panel;
- wherein the at least one middle panel is configured as a fan panel;
- wherein the fan panel includes at least one panel opening;

wherein the fan panel is configured to support attachment of at least one suspended fan;

wherein the at least one panel opening has a ledge disposed beneath a bottom edge thereof;

wherein the ledge is configured for temporary bearing support of the at least one suspended fan;

wherein the first side panel provides a front surface, a back surface, a frame attachment end, and a stiffening flange;

wherein the second side panel provides a front surface, a back surface, a frame attachment end, and a c-channel;

wherein the at least one middle panel provides a front surface, a back surface, a stiffening flange, and a c-channel;

wherein the stiffening flange of the first side panel interlocks and attaches with the c-channel of the at least one middle panel;

wherein the stiffening flange of the at least one middle panel interlocks and attaches with the c-channel of the second side panel;

wherein a tubular intermediate bulkhead stiffening element is formed by interlocking and attaching the stiffening flange and the c-channel of adjacent panels such that all of the front surfaces are aligned coplanar.

7. The modular bulkhead system of claim 6, wherein the first side panel is configured as an alternative first side panel providing the at least one panel opening, and is configured to provide support for the at least one suspended fan.

8. The modular bulkhead system of claim 6, wherein the second side panel is configured as an alternative second side panel providing the at least one panel opening, and is configured to provide support for the at least one suspended fan.

9. The modular bulkhead system of claim 6, wherein a structural frame is secured to the first side panel, the at least one middle panel, and the second side panel.

10. The modular bulkhead system of claim 6, wherein a transition frame is secured to the first side panel, the at least one middle panel, and the second side panel.

11. The modular bulkhead system of claim 6, wherein a quick-connect box is attached to the modular bulkhead wall.

12. The modular bulkhead system of claim 6, wherein the at least one middle panel includes at least one filler panel, wherein each of the stiffening flange and the c-channel of the at least one filler panel interlock and attach with each of the corresponding stiffening flange or c-channel of the adjacent panels.

13. The modular bulkhead system of claim 12, wherein the at least one filler panel is configured to provide a bulkhead door.

14. The modular bulkhead system of claim 6, wherein the c-channel includes a c-channel lip configured as an attachment surface for between adjacent panels.

15. The modular bulkhead system of claim 14, wherein the front surface of the c-channel lip abuts the back surface of the adjacent panel once the panels are interlocked and attached.

16. The modular bulkhead system of claim 14, wherein the c-channel lip is disposed within the tubular intermediate bulkhead stiffening element.

17. The modular bulkhead system of claim 14, wherein each c-channel lip is attached to an adjacent panel by fasteners that are connected through aligned pre-punched holes disposed in the c-channel lip and in the adjacent panel.

18. An HVAC modular bulkhead system for support of one or more suspended fans comprising:

a modular bulkhead wall;

wherein the modular bulkhead wall further comprises a first side panel, a second side panel, and a plurality of middle panels;

wherein each of the plurality of middle panels includes a front surface, a back surface, a stiffening flange, and a c-channel;

wherein the plurality of middle panels includes at least one filler panel and at least one fan panel;

wherein the at least one fan panel includes at least one panel opening;

wherein the at least one panel opening has a ledge disposed beneath the bottom edge thereof;

wherein the first side panel and the second side panel each include a front surface and a back surface;

wherein attached to one end of the first side panel and second side panel is either a stiffening flange or a c-channel;

wherein the stiffening flange or the c-channel of the first side panel and second side panel is interlocked and attached with the corresponding c-channel or stiffening flange of the adjacent panel;

wherein the stiffening flange or the c-channel of the filler panel is interlocked and attached with the corresponding c-channel or stiffening flange of the adjacent panel;

wherein the stiffening flange or the c-channel of the fan panel is interlocked and attached with the corresponding c-channel or stiffening flange of the adjacent panel;

wherein a tubular intermediate bulkhead stiffening element having a substantially enclosed horizontal cross-section is formed by interlocking and attaching the stiffening flange and the c-channel of adjacent panels, and the front surfaces of each adjacent panel are aligned colinear; and one or more fans;

wherein the one or more fans each has an integrally attached fan plate, each fan plate comprising a bottom edge;

wherein, during suspension of the one or more integrally attached fan and fan plate on the fan panel, the fan plate bottom edge is pivotably supported in the at least one panel opening ledge;

whereby the integrally attached fan and fan plate are pivoted upwardly such that the at least one fan plate covers the at least one fan panel opening and is attached thereto, and provides support for suspension of the at least one fan from the at least one fan panel.

* * * * *